US011421352B2

(12) United States Patent
Lin

(10) Patent No.: US 11,421,352 B2
(45) **Date of Patent: *Aug. 23, 2022**

(54) WOVEN TEXTILE

(71) Applicant: JING HUNG LIANG LTD., Changhua County (TW)

(72) Inventor: Ping-Kun Lin, Changhua County (TW)

(73) Assignee: JING HUNG LIANG LTD., Changhua County (TW)

( * ) Notice: Subject to any disclaimer, the term of this patent is extended or adjusted under 35 U.S.C. 154(b) by 10 days.

This patent is subject to a terminal disclaimer.

(21) Appl. No.: 17/154,029

(22) Filed: Jan. 21, 2021

(65) Prior Publication Data

US 2021/0140076 A1 May 13, 2021

Related U.S. Application Data

(63) Continuation-in-part of application No. 15/983,694, filed on May 18, 2018, now abandoned.

(51) Int. Cl.

| | |
|---|---|
| ***D03D 17/00*** | (2006.01) |
| ***D03D 11/00*** | (2006.01) |
| ***D03D 13/00*** | (2006.01) |

(52) U.S. Cl.
CPC ..... *D03D 17/00* (2013.01); *D03D 11/00* (2013.01); *D03D 13/004* (2013.01)

(58) Field of Classification Search
USPC ..... 139/383 A, 397, 398, 410, 411, 413; 442/206, 213, 243
See application file for complete search history.

(56) References Cited

U.S. PATENT DOCUMENTS

| | | | |
|---|---|---|---|
| 9,163,341 | B2 | 10/2015 | Nelis et al. |
| 2005/0247367 | A1 | 11/2005 | Debaes et al. |

*Primary Examiner* — Lynda Salvatore
(74) *Attorney, Agent, or Firm* — Muncy, Geissler, Olds & Lowe, P.C.

(57) ABSTRACT

A woven textile defines a longitudinal direction and a transverse direction and includes a first layer, a second layer, and at least one binding thread. The first layer includes at least one first braid extending in a sinusoidal wave pattern. The second layer includes a plurality of rows of second braid extending along the transverse direction in a sinusoidal wave pattern. The rows of second braid are aligned along the longitudinal direction and are separated. Each of the rows of second braid is stacked with the at least one first braid to form a plurality of overlap portions. The at least one binding thread is woven with each of the rows of second braid and the at least one first braid together at the overlap portions to fix the row of second braid and the at least one first braid.

5 Claims, 3 Drawing Sheets

WOVEN TEXTILE

The present invention is a CIP of application Ser. No. 15/983,694, filed May 18, 2018, and abandoned Jun. 10, 2021, the entire contents of which are hereby incorporated by reference.

BACKGROUND OF THE INVENTION

Field of the Invention

Description of the Prior Art

Woven textile is used widely. For example, clothes, shoes, and daily commodities are often made by woven textile. However, how the woven textile is woven, the material, and the design determine the characteristics of the woven textile.

Generally, to increase the thickness of the woven textile, wider threads or more complicated way to weave may be used. However, the elasticity is restricted thereby. In addition, the thickness can just be increased a few, and the softness and cushion is not good enough.

Another conventional woven textile having larger thickness is composed of two woven layers stacked together. However, the elasticity is still restricted.

US2005/0247367 discloses that the winding filament in the upper layer and the winding filament in the lower layer extending in a sinusoidal wave pattern as observed in the horizontal direction instead of the vertical direction. That is, the filaments look in a sinusoidal wave pattern at a cross-section along the thickness direction, just like FIG. 1*a* and FIG. 1*b*. Thus, FIG. 1*a* and FIG. 1*b* are obviously a cross-section view that observed along the horizontal direction. In addition, the reference number 6 is a "weft thread", which obviously extends along a surface of the fabric instead of the thickness direction. Other drawings also fail to teach that the filaments extend in a sinusoidal wave pattern along the horizontal plane. Furthermore, the filaments are woven together directly. Therefore, it fails to disclose the filaments extending in a sinusoidal wave pattern on a plane which is perpendicular to a thickness direction of the woven textile.

SUMMARY OF THE INVENTION

The main object of the present invention is to provide a woven textile having larger thickness and sufficient elasticity.

To achieve the above and other objects, the woven textile of the present invention defines a longitudinal direction and a transverse direction perpendicular to the longitudinal direction. The woven textile includes a first layer, a second layer, and at least one binding thread.

The first layer includes at least one first braid extending in a sinusoidal wave pattern. The second layer includes a plurality of rows of second braid extending along the transverse direction in a sinusoidal wave pattern. The rows of second braid are aligned along the longitudinal direction and are separated. Each of the rows of second braid is stacked with the at least one first braid to form a plurality of overlap portions. The at least one binding thread is woven with each of the rows of second braid and the at least one first braid together at the overlap portions to fix the row of second braid and the at least one first braid.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
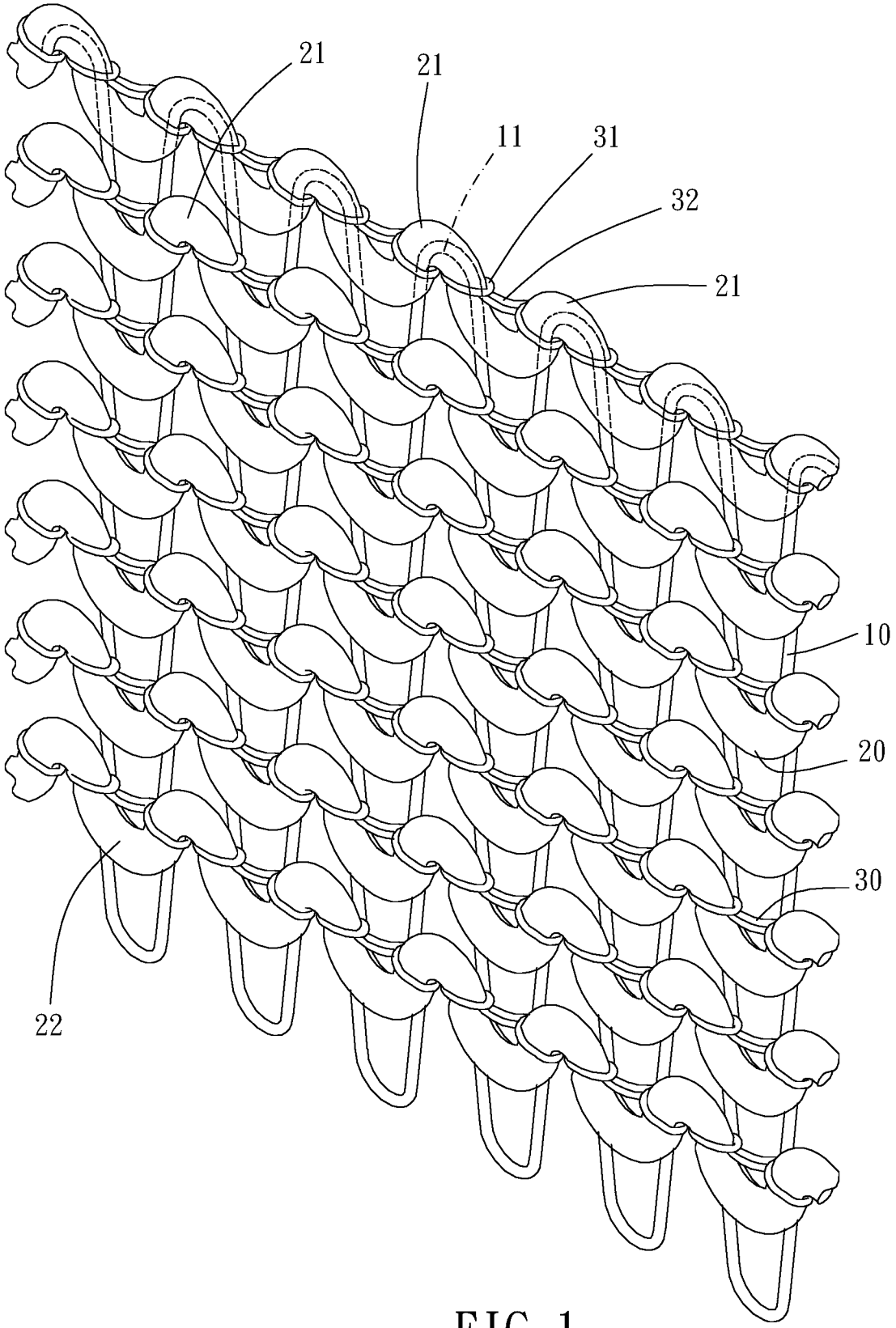
FIG. 1 is a stereogram of the present invention.
Figure 2:
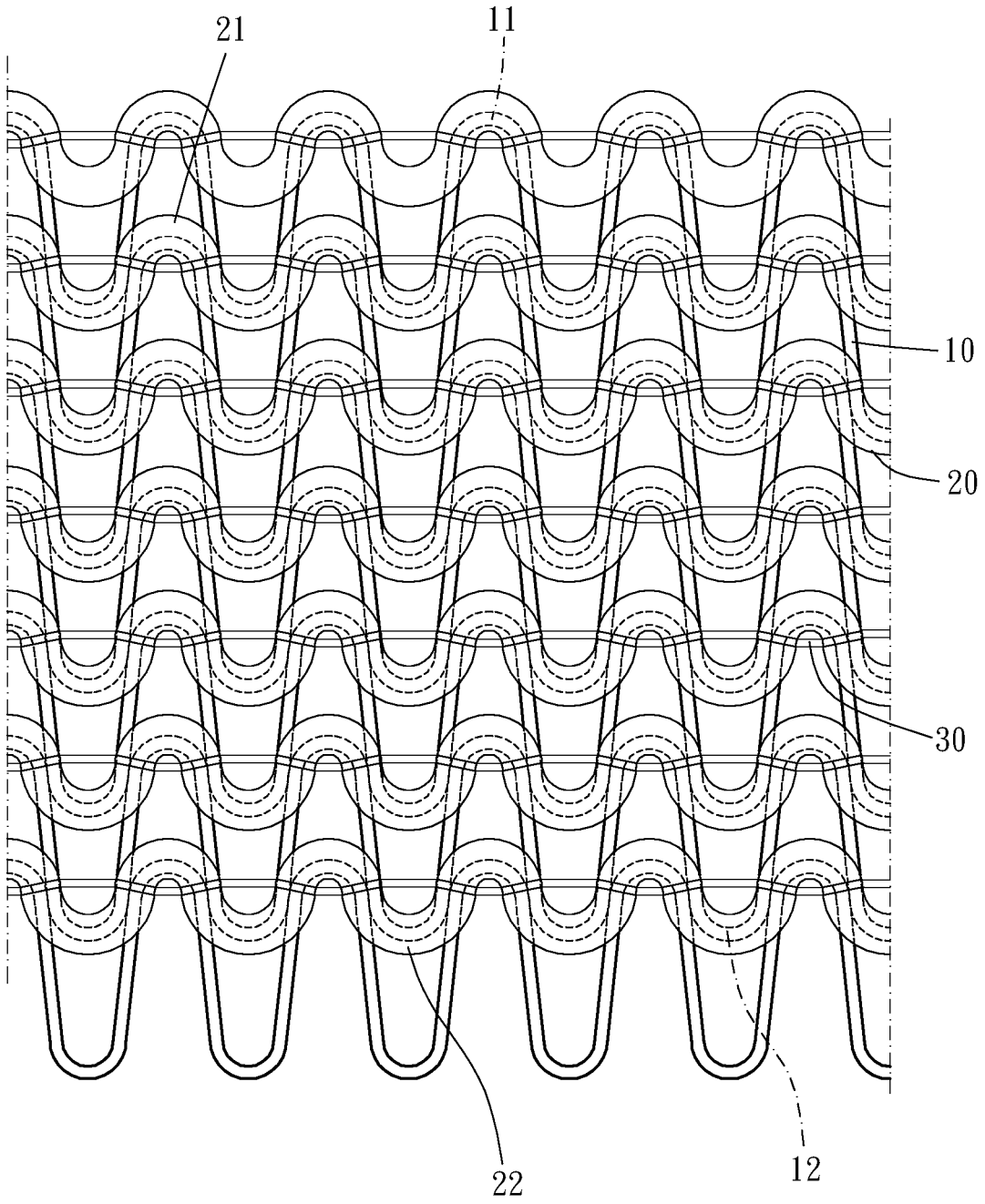
FIG. 2 is a top view of the present invention.
Figure 3:
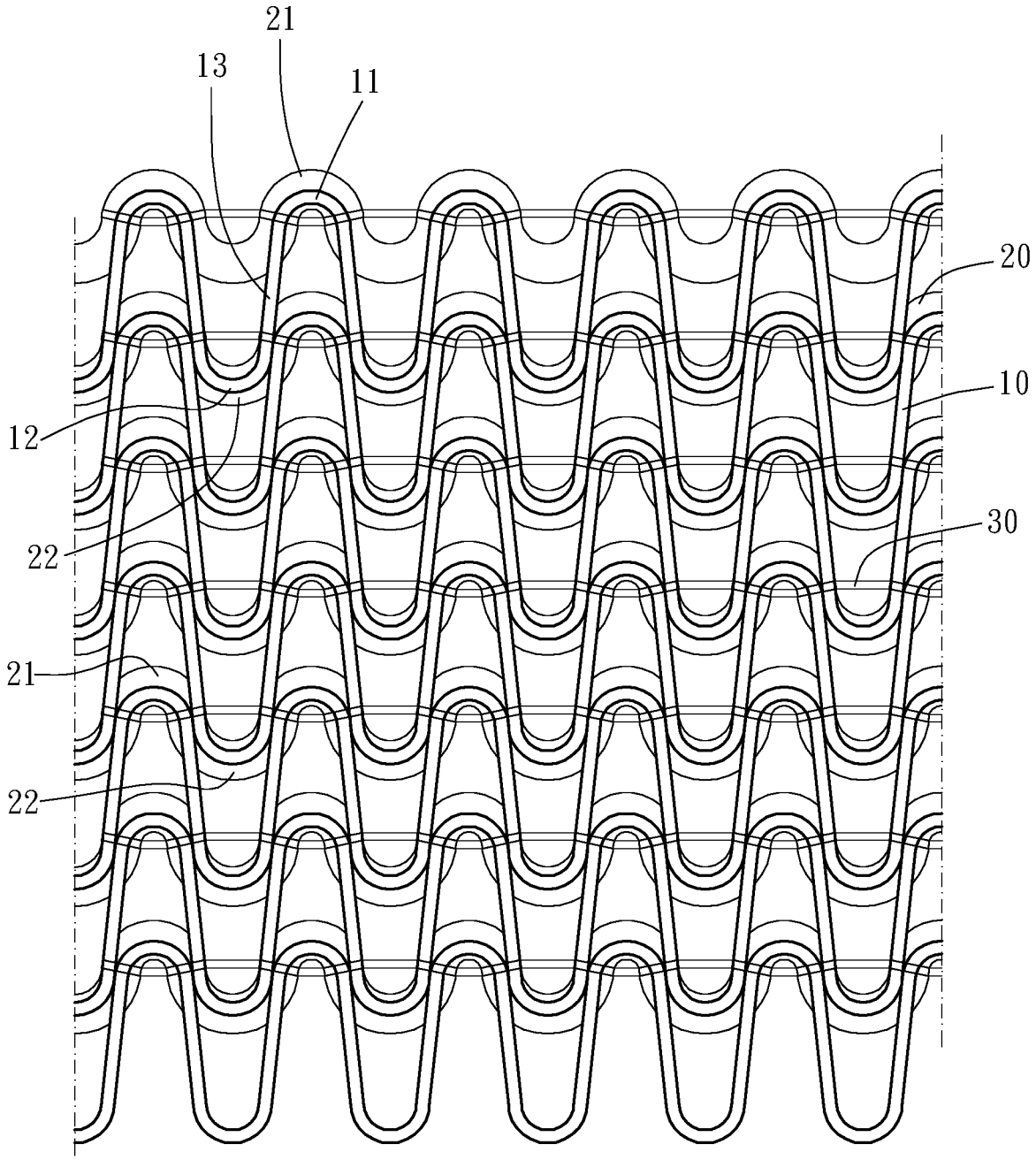
FIG. 3 is a bottom view of the present invention.

Please refer to FIG. 1 to FIG. 3, the woven textile of the present invention defines a longitudinal direction and a transverse direction perpendicular to the longitudinal direction. The woven textile includes a first layer, a second layer, and at least one binding thread 30.

An entirety of one of the first layer and the second layer is located wholly on a side of the other of the first layer and the second layer. The first layer includes at least one first braid 10 extending in a sinusoidal wave pattern. The second layer includes a plurality of rows of second braid 20 extending in a sinusoidal wave pattern along the transverse direction on a plane which is perpendicular to a thickness direction of the woven textile, wherein the thickness direction of the woven textile being perpendicular to the longitudinal and transverse directions. The rows of second braid 20 are aligned along the longitudinal direction and are separated. Each of the rows of second braid 20 is stacked with the at least one first braid 10 to form a plurality of overlap portions. The at least one binding thread 30 is woven with each of the rows of second braid 20 and the at least one first braid 10 together at the overlap portions to fix the row of second braid 20 and the at least one first braid 10.

In the present embodiment, the first layer includes a plurality of rows of the first braid 10 extending in a sinusoidal wave pattern along the transverse direction on another plane which is perpendicular to the thickness direction of the woven textile. Each of the rows of first braid 10 extends along the transverse direction in a sinusoidal wave pattern. The rows of first braid 10 are aligned along the longitudinal direction. Each of the rows of first braid 10 includes a plurality of first crests 11 and a plurality of first troughs 12. The first crests 11 of the rows of first braid 10 positionally correspond to each other. The first troughs 12 of the rows of first braid 10 positionally correspond to each other. Each of the rows of second braid 20 includes a plurality of second crests 21 and a plurality of second troughs 22. The first crests 11 of each of the rows of first braid 10 overlap the second crests 21 of one of the rows of second braid 20. The first troughs 12 of each of the rows of first braid 10 overlap the second troughs 22 of one of the rows of second braid 20 so that each of the rows of first braid 10 extends in a sinusoidal wave pattern between adjacent two of the rows of second braid 20. The at least one binding thread 30 is woven with an intermediate portion of each of the rows of second braid 20 between the second crests 21 and the second troughs 22. Preferably, a minimum distance between any two adjacent rows of second braid 20 is equal to or larger than 0.65 time a diameter of each of the rows of second braid 20 so as to ensure that any two adjacent rows of second braid 20 are separated and do not touch each other.

Each of the rows of first braid 10 further includes a plurality of connection sections 13, each of the plurality of connection sections 13 is integrally connected with and between one said first crest 11 and one said first trough 12 of one of the rows of first braid 10, and each of the plurality of connection sections 13 overlap and is connected between one said second crest 21 of one of the rows of second braid 20 and one said second trough 22 of another one of the rows of second braid 20. Each of the second crests 21 of each of the rows of second braid 20 overlap a single one of the first crests 11 of one of the rows of first braid 10, and each of the second troughs 22 of each of the rows of second braid 20 overlap a single one of the first troughs 12 of another one of the rows of first braid 10. The at least one binding thread 30 includes a plurality of tying sections 31 and a plurality of bridging sections 32, at least part of the plurality of tying sections 31 is disposed around and ties one of the plurality of rows of second braid 20 and two of the plurality of rows of first braid 10, and between every adjacent two of the plurality of second crests 21 are at least two of the plurality of bridging sections 32 which are not woven with each other.

Besides, the at least one first braid 10 is preferably woven by a plurality of filaments, and each of the rows of second braid 20 is also woven by a plurality of filaments. However, the way to weave is not limited. For example, the at least one first braid can include a plurality of filaments and a core. The filaments are woven around the core to be tube-shaped. Each of the rows of second braid can also include a plurality of filaments and a core. The filaments are woven around the core to be tube-shaped.

Thereby, the rows of second braid are separated so that the longitudinal elasticity of the second layer is not restricted. However, the second layer helps increase the thickness of the woven textile to provide not only better softness and cushion but also sufficient longitudinal elasticity. Besides, in the first embodiment, the amplitude of the first braid is larger than two times the amplitude of the second braid so that the first layer and the second layer have various elasticity for special use. In addition, the first layer and the second layer are not woven together directly so as to provide better elasticity, larger thickness, and softness.

What is claimed is:

1. A woven textile, defining a longitudinal direction and a transverse direction perpendicular to the longitudinal direction, the woven textile including:

a first layer, including a plurality of first braids extending in a sinusoidal wave pattern along the transverse direction on a plane which is perpendicular to a thickness direction of the woven textile, the thickness direction of the woven textile being perpendicular to the longitudinal and transverse directions, the plurality of first braids being aligned along the longitudinal direction and arranged in intervals;

a second layer, including a plurality of second braids extending in a sinusoidal wave pattern along the transverse direction on another plane which is perpendicular to the thickness direction of the woven textile, the second layer being layered on a side of the first layer, the plurality of second braids being aligned along the longitudinal direction and arranged in intervals, each of the plurality of second braids being stacked with the plurality of first braids to form a plurality of overlap portions;

at least one binding thread, the at least one binding thread being woven with each of the plurality of second braids and each of the plurality of first braids at the overlap portions to fix the plurality of second braids and the plurality of first braids;

wherein each of the plurality of first braids includes a plurality of first crests and a plurality of first troughs, the first crests of the plurality of first braids positionally correspond to each other, the first troughs of the plurality of first braids positionally correspond to each other;

wherein each of the plurality of second braids includes a plurality of second crests and a plurality of second troughs, the first crests of each of the plurality of first braids overlap the second crests of one of the plurality of second braids, the first troughs of each of the plurality of first braids overlap the second troughs of one of the plurality of second braids so that each of the plurality of first braids extends in a sinusoidal wave pattern between adjacent two of the plurality of second braids;

wherein each of the plurality of first braids further includes a plurality of connection sections, each of the plurality of connection sections is integrally connected with and between one said first crest and one said first trough of one of the plurality of first braids, each of the plurality of connection sections overlap and is connected between one said second crest of one of the plurality of second braids and one said second trough of another one of the plurality of second braids;

wherein each of the second crests of each of the plurality of second braids overlap a single one of the first crests of one of the plurality of first braids, each of the second troughs of each of the plurality of second braids overlap a single one of the first troughs of another one of the plurality of first braids.

2. The woven textile of claim 1, wherein the at least one binding thread is woven with an intermediate portion of each of the plurality of second braids between the second crests and the second troughs.

3. The woven textile of claim 1, wherein a minimum distance between any two adjacent of the plurality of second braids is equal to or larger than 0.65 times a diameter of each of the plurality of second braids.

4. The woven textile of claim 1, wherein each of the plurality of first braids is woven by a plurality of filaments.

5. The woven textile of claim 1, wherein each of the plurality of second braids is woven by a plurality of filaments.

* * * * *